US007704044B1

(12) United States Patent
Matheny

(10) Patent No.: US 7,704,044 B1
(45) Date of Patent: Apr. 27, 2010

(54) TURBINE BLADE WITH ATTACHMENT SHEAR INSERTS

(75) Inventor: Alfred P. Matheny, Jupiter, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 622 days.

(21) Appl. No.: 11/605,857

(22) Filed: Nov. 28, 2006

(51) Int. Cl.
*F01D 5/30* (2006.01)

(52) U.S. Cl. ..... 416/2; 416/218; 416/219 R; 416/220 R; 416/248

(58) Field of Classification Search ..... 416/215, 416/216, 218, 219 R, 220 R, 248
See application file for complete search history.

(56) References Cited

U.S. PATENT DOCUMENTS

| | | | | |
|---|---|---|---|---|
| 1,050,187 | A | 1/1913 | Westinghouse | |
| 1,347,031 | A | 7/1920 | Guy | |
| 1,415,266 | A | 5/1922 | Rice | |
| 2,430,185 | A | 11/1947 | Pescott | |
| 2,651,494 | A | 9/1953 | Persson | |
| 2,658,718 | A | 11/1953 | Walker | |
| 2,974,924 | A | 3/1961 | Rankin et al | |
| 4,022,545 | A * | 5/1977 | Shank | 416/221 |
| 4,767,275 | A | 8/1988 | Brown | |
| 5,073,084 | A | 12/1991 | Hirst | |
| 5,129,786 | A | 7/1992 | Gustafson | |
| 5,368,444 | A | 11/1994 | Anderson | |
| 5,372,481 | A | 12/1994 | Boyd | |
| 5,380,157 | A | 1/1995 | Shaffer | |
| 5,435,693 | A | 7/1995 | Shaffer | |
| 5,601,407 | A | 2/1997 | Humhauser | |
| 5,860,787 | A | 1/1999 | Richards | |
| 6,499,959 | B1 | 12/2002 | Reluzco et al. | |
| 6,595,747 | B2 * | 7/2003 | Bos | 415/209.4 |
| 6,761,537 | B1 | 7/2004 | Shapiro et al. | |
| 6,761,538 | B2 * | 7/2004 | Fitts et al. | 416/221 |
| 6,893,224 | B2 * | 5/2005 | Murphy | 416/220 R |

* cited by examiner

*Primary Examiner*—Igor Kershteyn
(74) *Attorney, Agent, or Firm*—John Ryznic

(57) ABSTRACT

A rotor disc and rotor blade assembly in which the rotor blades include curved shear pins to secure the blade to the rotor disc. The blade includes an airfoil portion with an airfoil outline shape at the junction of the airfoil with the platform, and the root extends below the platform and has the general shape of the airfoil at the junction. An opening in the rotor disc also has the shape of the airfoil outline such that the root will fit snuggly within the opening in the rotor disc. Curved slots in both the opening and the root wall are formed on both sides of the opening and the blade root. Shear pins having a rectangular cross sectional shape fit within the slots to secure the blade to the disc. Because the root curvature follows the airfoil shape, the shear pins are located below the airfoil walls and absorb the shear stress caused by bending forces acting on the airfoil from the fluid reaction.

23 Claims, 5 Drawing Sheets

TURBINE BLADE WITH ATTACHMENT SHEAR INSERTS

BACKGROUND OF THE INVENTION

1. Field of the Invention

The present invention relates generally to fluid reaction surfaces, and more specifically to attaching a turbine blade to a rotor disk.

2. Description of the Related Art Including Information Disclosed Under 37 CFR 1.97 and 1.98

A turbomachine includes a rotor disk with a plurality of rotor blades secured to the disk and spaced circumferentially around the disk. In some turbo-machines, the rotor disk rotates with such a high speed that the centrifugal forces are very high and tend to pull the blade out from the disk. Therefore, the structure in which the blade is secured to the rotor disk is very important.

Another problem with turbo-machines is the replacement of a damaged blade. It is desirable to make the removal and replacement of a damaged blade an easy process in order that the turbomachine can be brought back into operation with a minimal down time.

One prior art blade attachment method is shown in U.S. Pat. No. 5,129,786 issued to Gustafson on Jul. 14, 1992 and entitled VARIABLE PITCH FAN BLADE RETENTION ARRANGEMENT which discloses a fan blade attached to a disc arm by circular shaped pins secured within first and second seating grooves formed in the blade root and the disc arm opening. One problem with the Gustafson invention is that the circular retaining pins cannot withstand very high shear stress that would result in a turbomachine such as a compressor that operates at high rotational speeds. Another problem with the Gustafson invention is that the resulting force of the fluid acting on the surface of the blade will cause the blade root portion to bend within the supporting opening in the disc arm. In the Gustafson invention, because the retaining pins do not follow the outline of the airfoil surface, the airfoil bending load does not transfer directly to the shear pin.

Another prior art blade retaining method is shown in U.S. Pat. No. 2,974,924 issued to Rankin on Mar. 14, 1961 and entitled TURBINE BUCKET RETAINING MEANS AND SEALING ASSEMBLY which discloses a turbine blade (bucket) attached to the rotor disk by pins fitted within slots on the sides of the blade and the opening of the rotor disk. Four pins for each blade are used, with two pins on each side of the blade root, and where the two pins on the side are angled or offset along a straight line from each other. This offset arrangement of the retaining pins will support the shear loads from the bending force acting on the airfoil surface more than in the above cited Gustafson invention, but still not like the present invention. also, Rankin discloses the retaining pins to be circular or round in cross sectional shape, but also discloses that the pins can have a square cross section (see column 2, line 60).

It is therefore an object of the present invention to provide for a blade retaining method in which the blade can be easily removed and inserted into the rotor disk.

It is another object of the present invention to provide for a retaining pin used to secure a rotor blade within a rotor disk that can withstand high shear stress levels and therefore allow for higher rotational speeds for the bladed rotor disk.

It is another object of the present invention to provide for a blade retaining method in a rotor disk that will transfer more of the airfoil bending force to the shear pin more than any of the cited prior art references.

It is also another object of the present invention to provide for a rotor blade secured to a rotor disk using the well known fir tree configuration that includes all of the above objectives.

BRIEF SUMMARY OF THE INVENTION

The present invention is a rotor blade secured to a rotor disk by shear pins that have a rectangular cross sectional shape such that the shear pins can be bent within the retaining slot of the blade and disk assembly, yet also provide for high shear stress levels. The rotor blade includes a root portion that extends from the blade platform and follows the shape of the airfoil surfaces on the pressure and suction sides and the leading and trailing edges. Rectangular shaped slots are formed on both the blade root portion and the opening in the rotor disk and opposed there-from such that the rectangular shaped shear pin will fit within the slot halves when the blade is mounted in the disk opening. Because the slots follow the shape of the airfoil surfaces, the slots are curved. When the shear pin is inserted within the slots, the shear pin will also be curved. The curved shear pins follow the shape of the airfoil surface and therefore the bending forces from the blade will transfer directly into the shear pins.

DETAILED DESCRIPTION OF THE INVENTION

Figure 1:
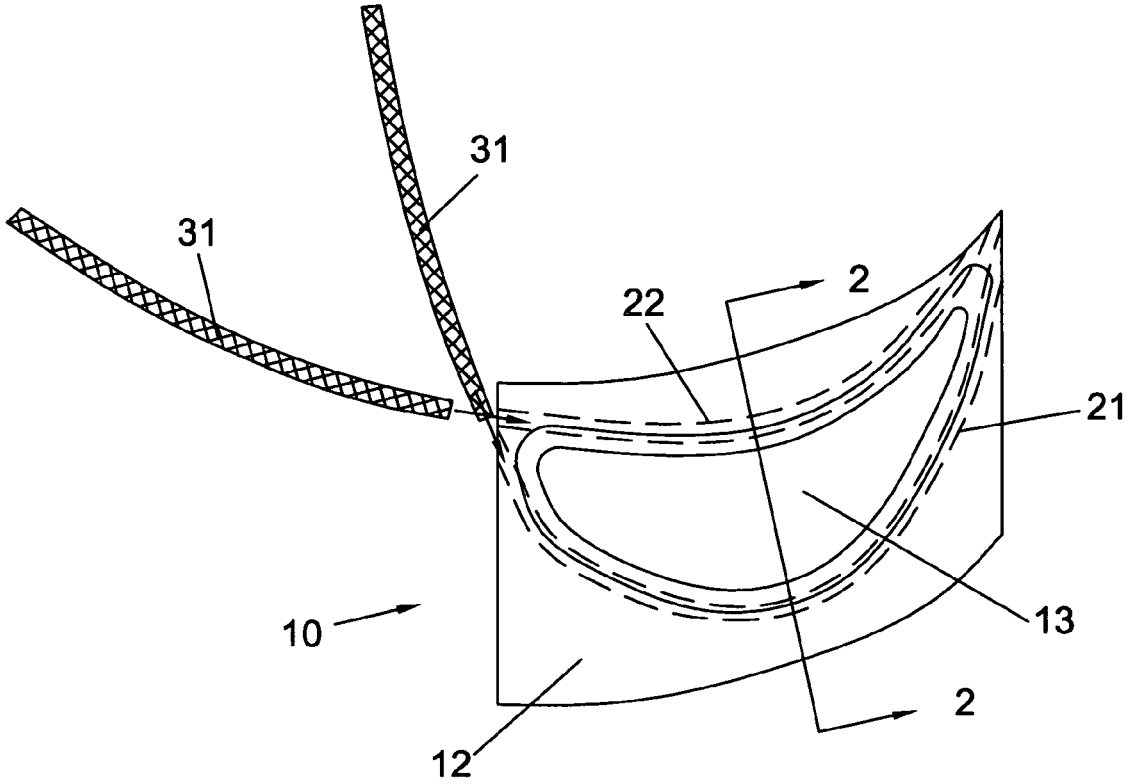
FIG. 1 shows a top view of a rotor blade with a platform and the shear pins prior to insertion within the retention slots.

The present invention is an apparatus for retaining a rotor blade within a rotor disk for easy removal and insertion, and also in such as way that higher shear forces can be accommodated. FIG. 1 shows a top view of the rotor blade 10 of the present invention with a platform 12, the blade airfoil 13 having a pressure side and a suction side, and a leading edge and trailing edge. Underneath the platform 12 and within the root portion of the blade extending beneath the platform are shear pin retention slots 21 and 22 formed within both the blade root portion and an opening within the rotor disk. A suction side retention slot 21 and a pressure side retention slot 22 are shown in dashed lines in FIG. 1 and follow the shape of the airfoil portion at the intersection of the airfoil to the platform. Shear pins 31 are inserted into the retention slots to secure the blade against radial movement due to rotation of the blade and disk.

FIG. 1 shows the slots 21 and 22 extending from one edge of the platform to another edge such that the slot does not have an end. In this situation, when a shear pin 31 is inserted into the slot from one end, the shear pin can be removed by forcing the pin out either way. In an alternate embodiment, the slots 21 and 22 could end before opening out from the platform edge.

Figure 2:
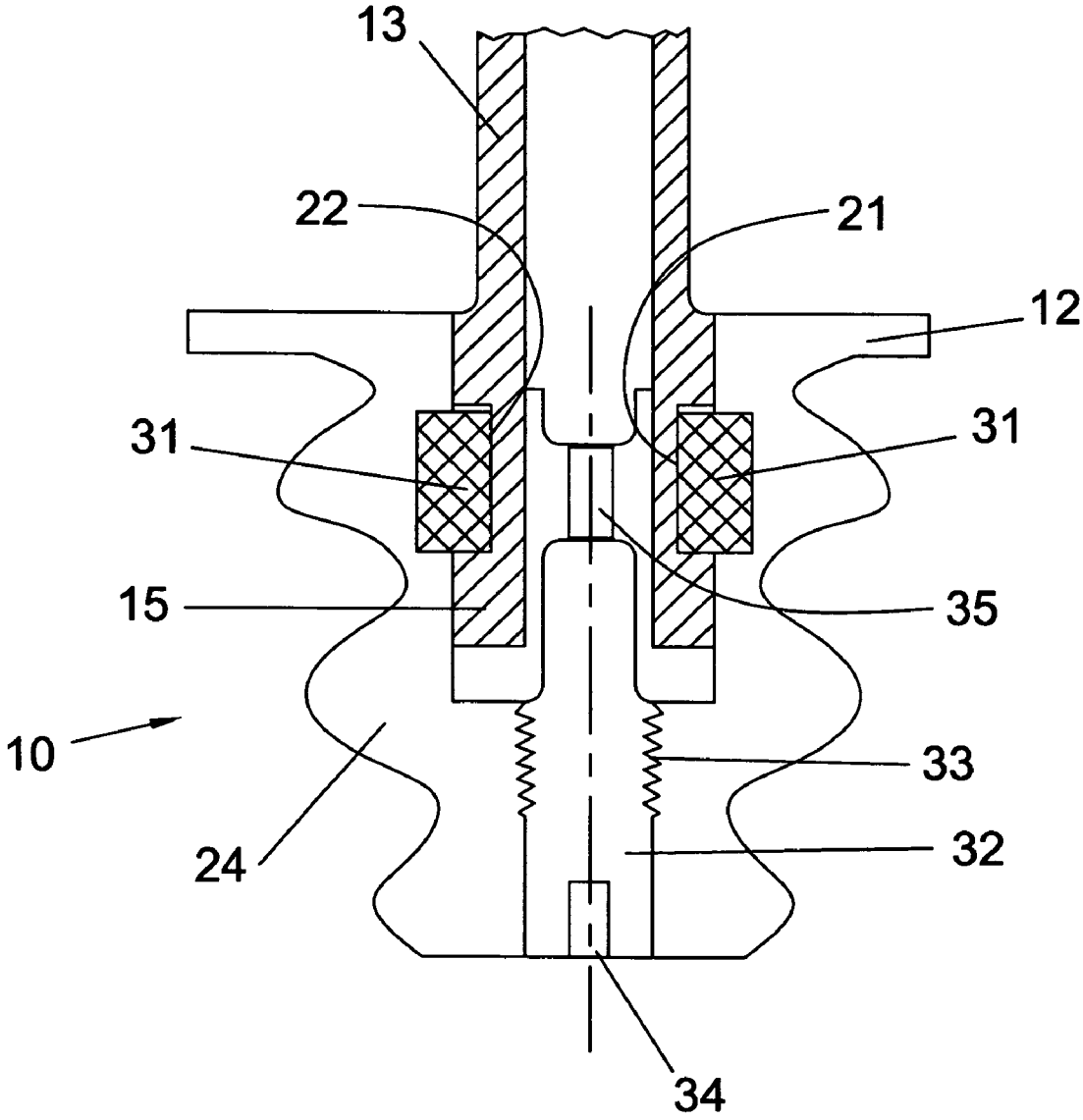
FIG. 2 shows a cross section view of a rotor blade secured within a fir tree and platform member with the shear pins of the present invention.

FIG. 2 shows a cross section of the details of the retention assembly of the present invention of FIG. 1. The blade 13 includes a root portion 15 which is secured within a fir tree member 24, the assembly of which is then inserted into the fir tree slots formed within the rotor disk according to any of the well known fir tree slots of the prior art. The fir tree member 24 is considered to be a blade support member. Within the root portion 15 of the blade 13 are formed the retention slots 21 and 22 that have a rectangular cross section shape. The retention slot 21 on the right side of the blade faces outward and the retention slot 22 of the left side faces outward. In this embodiment, the slots 21 and 22 in the blade root 15 face outward from the root and away from each other. Similar shaped retention slots are also formed within the fir tree member 24. The shear pins 31 are shown in position and fit tight enough to prevent the blade from pulling out from the fir tree member 24 due to the centrifugal force from rotation. A threaded plug 32 screws into the bottom of the fir tree member 24 after the shear pins 31 are inserted and provides a load on the pins 31. Threads 33 are formed on the plug 32 and the opening within the fir tree member 24. A tool engagement member such as a screw driver slot 34 is formed on the bottom of the plug 32 to allow for a tool to rotate the plug 32 to provide the preload against the shear pins 31. An abutment member 35 is secured between an abutment face on the bottom of the blade 13 and an abutment face on the top of the plug 32 to accommodate any space between the blade 13 and the plug 32.

The shear pins 31 are made of a nickel allow for high strength and for high temperature resistance. The shear pins 31 are also rectangular in cross sectional shape with the width being the lesser of the lengths in order that the pin can bend within the slots when inserted and to provide high shear stress resistance. The square shaped pin of the Rankin et al patent described above will not bend very easily and would require insertion by such a high force that the slots could be damaged. Also, because the pin is square shaped, the thickness would have to be less and therefore the resistance to the shear stress would be a lot less than the rectangular shaped pin of the present invention.

The retention process for the blade of FIG. 1 will now be described. The rotor blade 13 is inserted into the fir tree member 24 such that the slots line up in an opposing manner and form the rectangular shaped insertion slot for the shear pins 31. a person would know when the slots are aligned because the platform would be flush with the curved portion on the blade. The shear pins 31 are then inserted until the ends of the pins are not sticking out from the slot openings. The abutment member 35 is inserted, and the plug 32 is screwed into the threaded hole formed in the bottom of the fir tree member 24 until it is tight. When tightened, a preload force is applied to the shear pins 31 against the slots 21 and 22 to prevent the shear pins 31 from coming out of the slots. A locking member can also be used to prevent the plug 32 from loosening due to vibrations.

Figure 3:
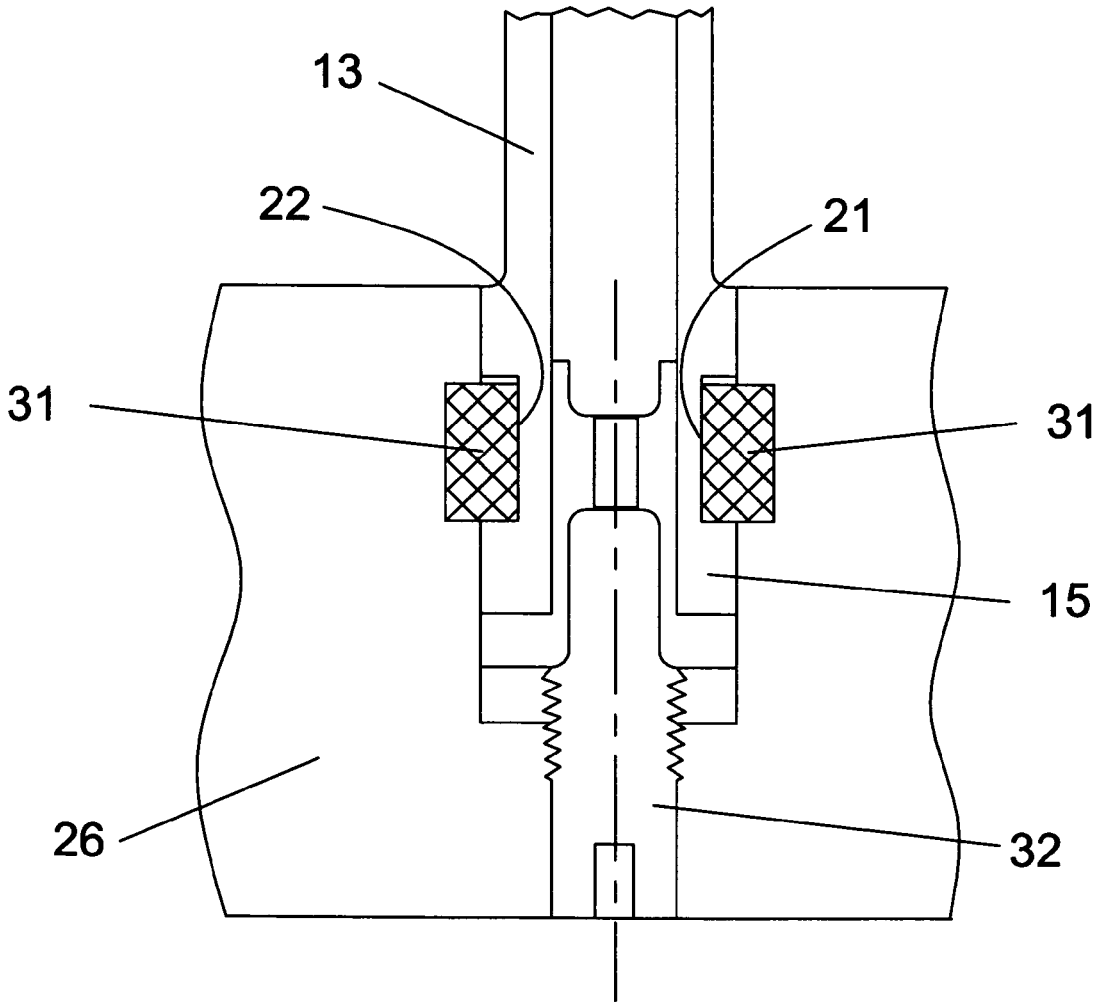
FIG. 3 shows a cross section view of a second embodiment of the present invention in which a rotor blade is secured within a rotor disk without the fir tree configuration.

FIG. 3 shows a second embodiment of the present invention. In this embodiment, the fir tree member 24 of the FIG. 2 embodiment is not used. The blade 13 with the root portion 15 is inserted directly into an opening formed within the rotor disk 26. The rotor disk 26 in this embodiment is considered to be the blade support member. The inside surface of the rotor disk opening would have the slot formed thereon and opposed to the slot location in the root 15 when the blade 13 is in the proper position within the opening of the disk 26. The disk 26 would also have the threaded opening for the insertion of the plug 32 to provide the preload to the shear pins 31 when they are inserted into the slots 21 and 22. In this embodiment, the slots 21 and 22 in the blade root 15 face outward and away from each other.

In the FIG. 2 embodiment, a blade having a fir tree shaped root could be replaced with a blade secured within the fir tree member by the shear pins of the present invention. A blade with the fir tree shaped root would then not be needed, and the blade of the present invention could then be easily replaced without have to disassemble rotor disks in a multiple stage turbomachine as in the prior art. A damaged blade could be easily removed by pulling the blade out from the opening in the rotor disk. A new blade could then be easily inserted and secured by the shear pins of the present invention.

Figure 4:
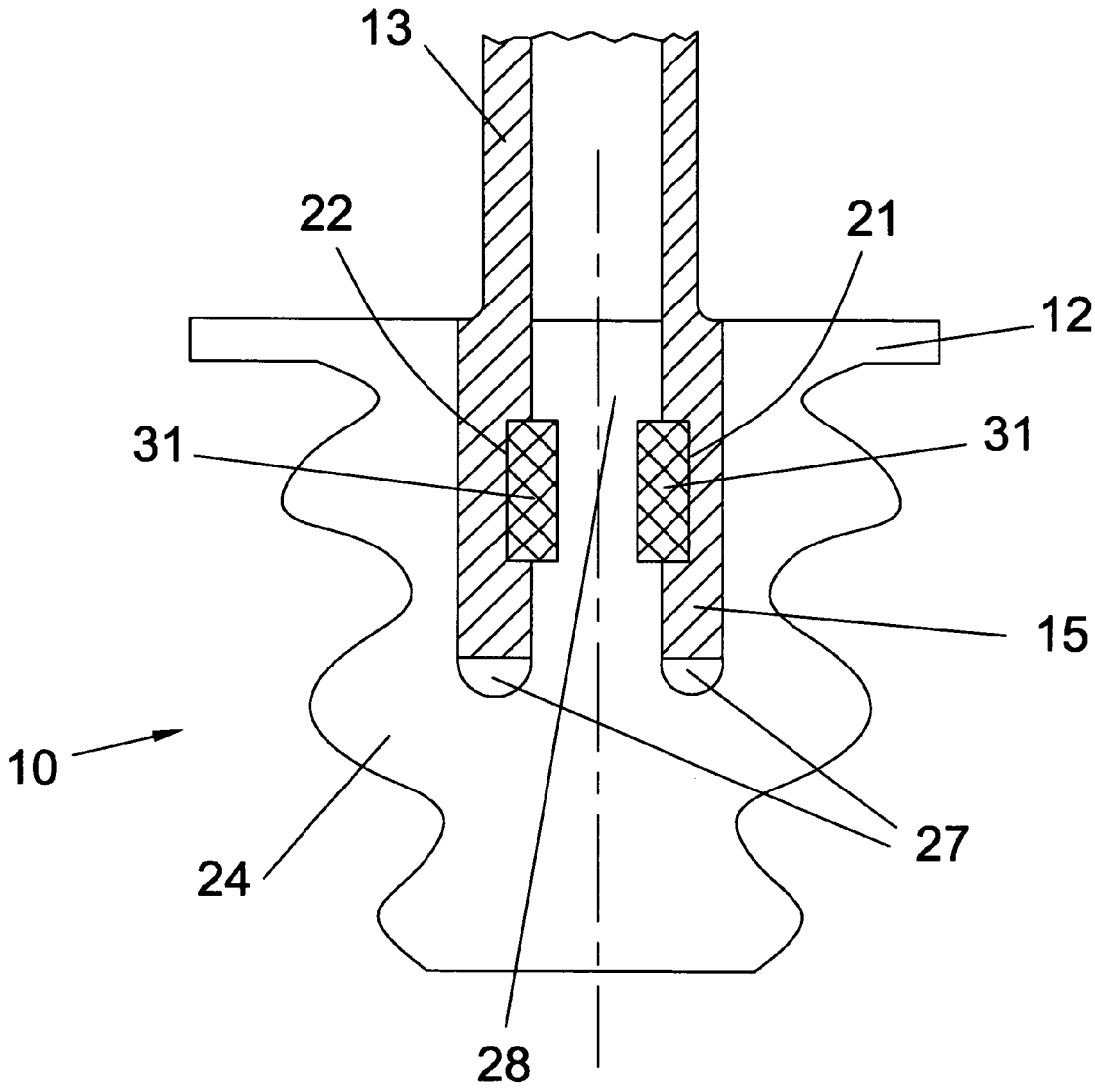
FIG. 4 shows a cross section view of a third embodiment of the present invention.

A third embodiment of the turbine blade with attachment shear inserts is shown in FIG. 4 and is similar to the embodiment in FIG. 2 but with the shear pins 31 inserted along slots formed on the inside wall of the blade 13. A fir tree member 24 in the FIG. 4 embodiment includes slots 27 forming a fir tree projection 28 between the two slots 27. The blade 13 fits within the slots 27 of the fir tree member 24. Both the blade 13 and the projecting member 28 include the curved slots 21 and 22 in which the shear pins 31 and inserted as in the previous embodiments. The slots 21 and 22 formed in the blade 13 faces inward and toward each other in the FIG. 4 embodiment instead of facing outward in the FIG. 2 and FIG. 3 embodiments. With the FIG. 4 location of the slot 21 and 22, the load from the blade is balanced and, as a result, the support structure receives reduced moment.

Figure 5:
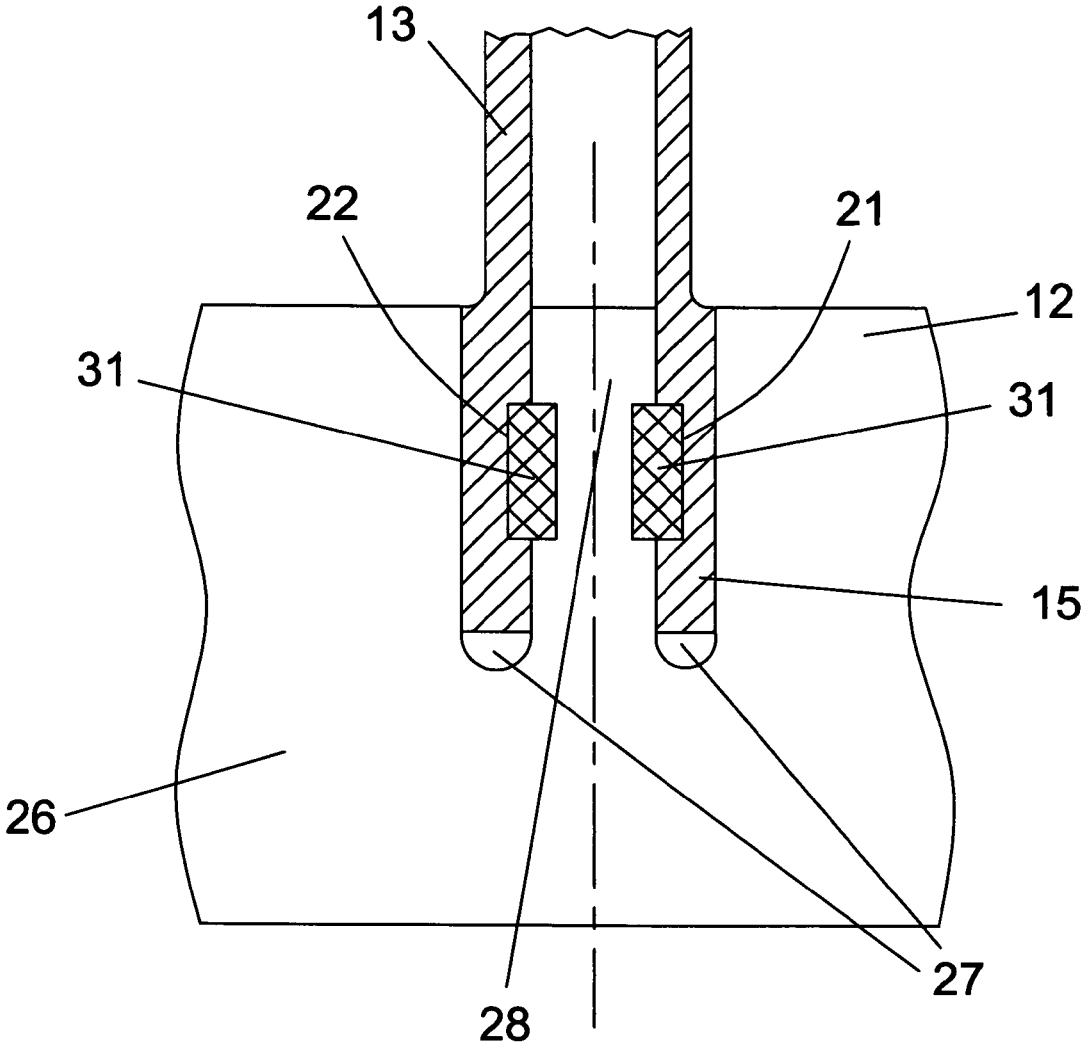
FIG. 5 shows a cross section view of a fourth embodiment of the present invention in which a rotor blade is secured within a rotor disk without the fir tree configuration using the slot location arrangement of the third embodiment.

FIG. 5 shows a fourth embodiment of the turbine blade with attachment shear inserts in which the slot arrangement facing inward of the FIG. 4 design is used in a rotor disk 26 having the slots 27 formed therein instead of the fir tree member as in the FIGS. 2 and 4 embodiments. The blade root 15 includes slots 21 and 22 that face inward and toward each other. The rotor disk 26 includes the slots 27 in which the blade root 15 is inserted, and define the projecting member 28. The slots on the projecting member 28 face outward while the slots 21 and 22 on the blade 13 face inward.

I claim the following:

1. A rotor assembly for a turbomachine, comprising:

a rotor disk having at least one opening to receive a rotor blade;

a rotor blade having an airfoil portion and a root portion, the airfoil portion having a pressure side wall and a suction side wall;

the root portion of the blade having sides following substantially the shape of the airfoil side walls;

slots formed on the rotor disk opening and on the blade root, the slots having a curvature generally following the curvature of the airfoil wall above the slot; and, a shear pin located within the slot to secure the blade against radial movement within the rotor disk opening.

2. The rotor assembly of claim 1, and further comprising:

the opening in the rotor disk is a fir tree shaped member secured in a fir tree shaped slot in the rotor disk; and, the opening for the blade root being formed in the fir tree member.

3. The rotor assembly of claim 1, and further comprising:

the shear pins having substantially a rectangular cross section shape such that the shear pin is capable of flexing in the curved slot while maintaining high shear stress resistance.

4. The rotor assembly of claim 1, and further comprising:

a plug inserted within the opening to engage the blade root and provide a preload to the shear pin.

5. The rotor assembly of claim 4, and further comprising:
the plug being threadably engaged with the opening in order to apply the preload to the shear pin.

6. The rotor assembly of claim 1, and further comprising:
the shear pin being formed substantially from a nickel alloy.

7. The rotor assembly of claim 1, and further comprising:
slots are formed on both sides of the root walls and the rotor disk opening; and,
a shear pin inserted into both of the slots to retain the blade within the rotor disk against radial movement.

8. The rotor assembly of claim 4, and further comprising:
an abutment member positioned between the plug and the blade root.

9. The rotor assembly of claim 1, and further comprising:
the slots on the blade root are on an inner surface of the blade root and face inward and toward each other.

10. The rotor assembly of claim 1, and further comprising:
the slots on the blade root are on an outer surface of the blade root and face outward and away each other.

11. A rotor assembly for a turbomachine, comprising:
a rotor disk having at least one opening to receive a rotor blade;
a rotor blade having an airfoil portion and a root portion, the airfoil portion having a pressure side wall and a suction side wall;
the opening in the rotor disk and the blade root sides each having a slot of substantially the same size; and,
a shear pin located within the slot to secure the blade against radial movement within the rotor disk opening, the slots and the shear pin having a substantially rectangular cross sectional shape in which the height of the shear pin in the blade radial direction is at least twice the length of the width of the shear pin.

12. The rotor assembly of claim 11, and further comprising:
the opening in the rotor disk is a fir tree shaped member secured in a fir tree shaped slot in the rotor disk; and,
the opening for the blade root being formed in the fir tree member.

13. The rotor assembly of claim 11, and further comprising:
a plug inserted within the opening to engage the blade root and provide a preload to the shear pin.

14. The rotor assembly of claim 13, and further comprising:
the plug being threadably engaged with the opening in order to apply the preload to the shear pin.

15. The rotor assembly of claim 11, and further comprising:
the shear pin being formed substantially from a nickel alloy.

16. The rotor assembly of claim 11, and further comprising:
slots are formed on both sides of the root walls and the rotor disk opening; and,
a shear pin inserted into both of the slots to retain the blade within the rotor disk against radial movement.

17. The rotor assembly of claim 13, and further comprising:
an abutment member positioned between the plug and the blade root.

18. The rotor assembly of claim 11, and further comprising:
the slots on the blade root are on an inner surface of the blade root and face inward and toward each other.

19. The rotor assembly of claim 11, and further comprising:
the slots on the blade root are on an outer surface of the blade root and face outward and away each other.

20. A rotor blade for use in a turbomachine, the rotor blade comprising:
an airfoil portion having a pressure side wall and a suction side wall;
a root portion extending from the airfoil portion, the root portion having side walls of substantially the same shape as the pressure and suction side walls; and,
a slot located on each of the root side walls, the slots having a substantially rectangular cross sectional shape in which the height is at least twice the length as the overall width of the two slots combined, and each slot having a bottom such that each slot can be filled with a shear pin.

21. The rotor blade of claim 20, and further comprising:
the slots on the blade root are on an inner surface of the blade root and face inward and toward each other.

22. The rotor blade of claim 20, and further comprising:
the slots on the blade root are on an outer surface of the blade root and face outward and away each other.

23. A rotor blade for use in a turbomachine, the rotor blade comprising:
an airfoil portion having a pressure side wall and a suction side wall;
a root portion extending from the airfoil portion, the root portion having side walls of substantially the same shape as the pressure and suction side walls;
a slot located on each of the root side walls, the slots having a substantially rectangular cross sectional shape in which the height is at least twice the length as the overall width of the two slots combined; and,
the blade root having an abutment face within an opening of the root to engage with a plug member.

* * * * *